United States Patent [19]

Sims, Jr.

[11] 4,002,879

[45] Jan. 11, 1977

[54] DOUBLE COLUMN LEAF SPRING PUSH-BUTTON SWITCH

[75] Inventor: Dewey M. Sims, Jr., Westland, Mich.

[73] Assignee: Burroughs Corporation, Detroit, Mich.

[22] Filed: Aug. 26, 1975

[21] Appl. No.: 607,894

[52] U.S. Cl. ..... 200/159 A; 200/67 DB

[51] Int. Cl.[2] ..... H01H 13/52

[58] Field of Search ..... 200/5 R, 5 A, 67 D, 200/67 DA, 67 DB, 86 R, 159 R, 159 A, 159 B

[56] References Cited

UNITED STATES PATENTS

| | | | |
|---|---|---|---|
| 2,469,650 | 5/1949 | Isserstedt | 200/159 A X |
| 2,658,972 | 11/1953 | Brown | 200/18 |
| 2,923,787 | 2/1960 | Nelson | 200/67 DB |
| 3,505,631 | 4/1970 | Kondo | 200/159 R X |
| 3,849,611 | 11/1974 | Walker, Jr. | 200/159 A X |
| 3,902,032 | 8/1975 | Koepke | 200/159 A X |

*Primary Examiner*—James R. Scott
*Attorney, Agent, or Firm*—Manuel Quiogue; William B. Penn; Kevin R. Peterson

[57] ABSTRACT

A push-button switch including a keytop plunger, a base structure for retaining and guiding the key top plunger, and a pair of biasing contact members. The biasing contact members are a pair of opposing column springs mounted in the base structure and are positioned to be bowed into engagement by the depression of the keytop plunger. Specifically, the column leaf spring members are mounted opposite each other to form mirror images. The complete structure is mounted on a printed circuit board with the leaf spring members connected to respective contact leads on the PC board.

15 Claims, 5 Drawing Figures

DOUBLE COLUMN LEAF SPRING PUSH-BUTTON SWITCH

BACKGROUND OF THE INVENTION

The present invention is related in subject matter to Ser. No. 534,825, titled "Column Leaf Spring Push-Button Switch," filed by the same inventor on Dec. 20, 1974 and assigned to the assignee of the present invention.

This invention generally relates to a manually actuable switching apparatus for engaging electrical contacts to complete an electrical conductive path. Specifically, the invention relates to a push-button switch for electrically completing an electrical circuit in a keyboard apparatus. The switch includes a pair of leaf spring members which serve as a biasing means for the keytop plunger and also as selectively engageable contact means for completing an electrical conductive path.

Push-button switches have been previously incorporated in keyboards used for selectively interconnecting electrical circuits. For example, these switches may be employed in a keyboard of an electronic calculator or the like. However, prior art devices have certain disadvantages such as complexity due to a large number of parts and the resulting high production costs. Another disadvantage of prior art devices is the ambiguity of whether the switch-make point has been achieved. A further disadvantage encountered in the prior art devices is excessive contact bounce upon making contact.

The present invention is designed to overcome the disadvantages of the prior art by providing novel features which accomplish certain desired features.

It is therefore an object of this invention to provide a simple and low cost push-button switch which may be used in a keyboard.

It is a further object of this invention to provide an improved push-button switch having relatively few and simple parts.

Still another object of the invention is to provide a switching mechanism having improved electrical characteristics including minimal contact bounce and definite electrical contact between selectively contacting members.

SUMMARY OF THE INVENTION

The push-button switch of the present invention achieves the above and other objects by providing a pair of column leaf springs which serve as both biasing members and as contact members. The springs are mounted opposite and facing each other and are secured at their lower ends by a guide base which is mounted on a printed circuit board. The leaf springs are appropriately connected to their respective contact leads on the printed circuit board. The upper ends of the column leaf springs are securely positioned against the underside of a keytop plunger. The guide base has a vertical support member which serves to place an initial bias upon the leaf springs and also serves as a vertical displacement guide for the keytop plunger which partially surrounds the vertical support member. A further embodiment of the present invention uses leaf springs having curved horizontal cross sections, which springs have their convex sides facing each other. The use of such springs removes the requirement that the support member provide an initial bias and allows the use of shorter springs. The keytop plunger has outwardly extending retaining shoulders which engage a cover plate to limit the upward vertical displacement of the keytop plunger.

BRIEF DESCRIPTION OF THE DRAWING

The foregoing objects, features and advantages of the invention along with other objects and advantages which may be obtained by its use, will be apparent from the following detailed description when read in conjunction with the accompanying drawing wherein.

DETAILED DESCRIPTION OF THE PREFERRED EMBODIMENT

Figure 1:
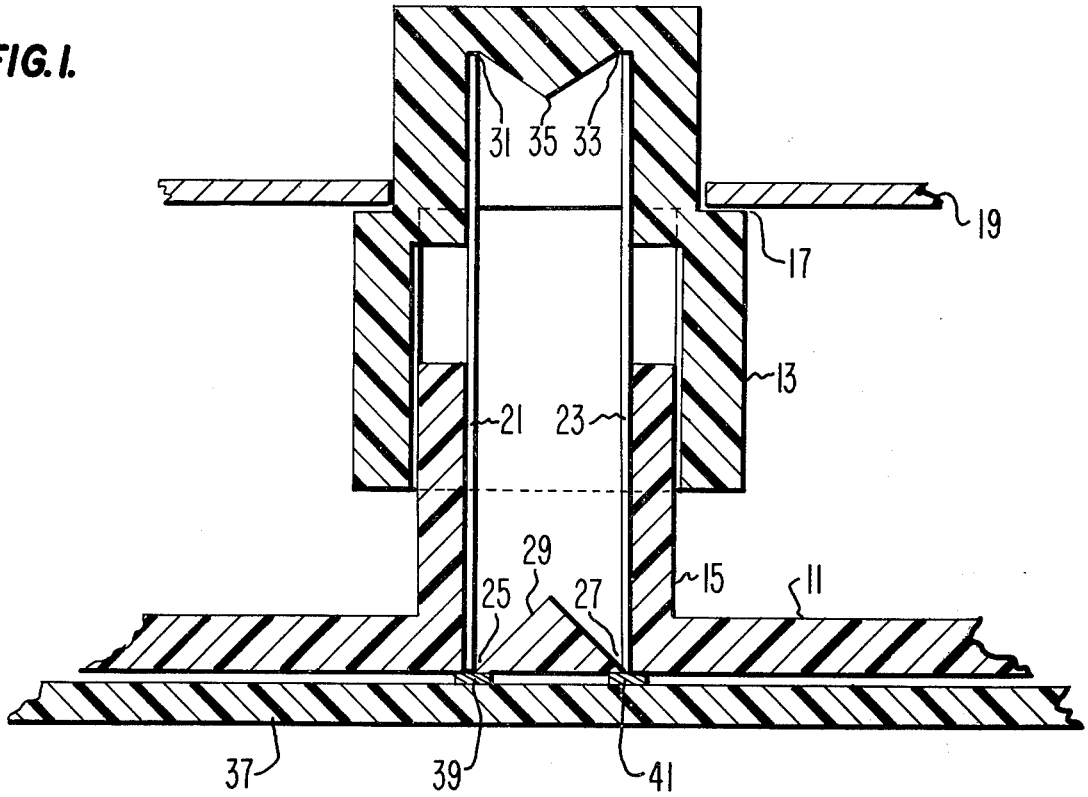
FIG. 1 is a cross sectional view of the push-button switch of the present invention showing a side view of the column leaf spring in a relaxed position.

The push-button switch of the present invention includes a guide base 11 which serves as a vertical displacement guide for a keytop plunger 13 which is mounted above and around a vertical support member 15 which forms part of the guide base 11. The keytop plunger includes outwardly extending shoulders 17. A stationery cover plate 19 is appropriately mounted to limit the upward displacement of the keytop plunger 13 by engaging the retaining shoulder 17 when the keytop plunger 13 is in an undepressed position.

Within the structure formed by the guide base 11 and the keytop plunger 13 are a pair of column leaf springs 21, 23 which form the biasing and contacting mechanism of the present invention. The column leaf springs 21, 23, are fixedly positioned at their lower ends in the corners 25, 27 formed between a lower part of the inner surface of the vertical support member 15 and a triangular wedge 29. The upper ends of the leaf springs 21, 23 are kept in position in corners 31, 33 which are formed on the inside of the keytop plunger 13 by the intersection of the inside surface of the keytop plunger 13 and a wedge-like extention 35. The dimensions of the vertical support member, the keytop plunger 13, and the leaf springs 21, 23 as well as the location of the cover plate 19 are appropriately chosen to insure that the retaining shoulder 17 rests against the bottom side of the cover plate 19 when the column leaf springs 21, 23 are in a relaxed position. The inner dimensions of the vertical support member 15 are chosen to provide an initial inward bias on the leaf spring 21, 23. This initial bias on the leaf springs 21, 23 facilitates actuation of the springs 21, 23 into a bowed position upon depression of the keytop plunger 13.

The guide base 11 is mounted on a printed circuit board 37 which has metal lands 39, 41 which are appropriately disposed on the top surface of the PC board 37 for connection to the leaf springs 21, 23. Appropriate leads on the circuit printed board 37, which are not shown, may be connected to the desired electrical circuitry. From the foregoing it can be seen that a plurality of switching structures may be disposed on a printed circuit board to form a keyboard. For example, a guide base 11 may be formed with a plurality of vertical support members 15 for accepting a plurality of keytop plungers 13. The cover plate 19 may be made with a plurality of apertures through which the upper portions of the keytop plunger 13 may extend.

Figure 2:
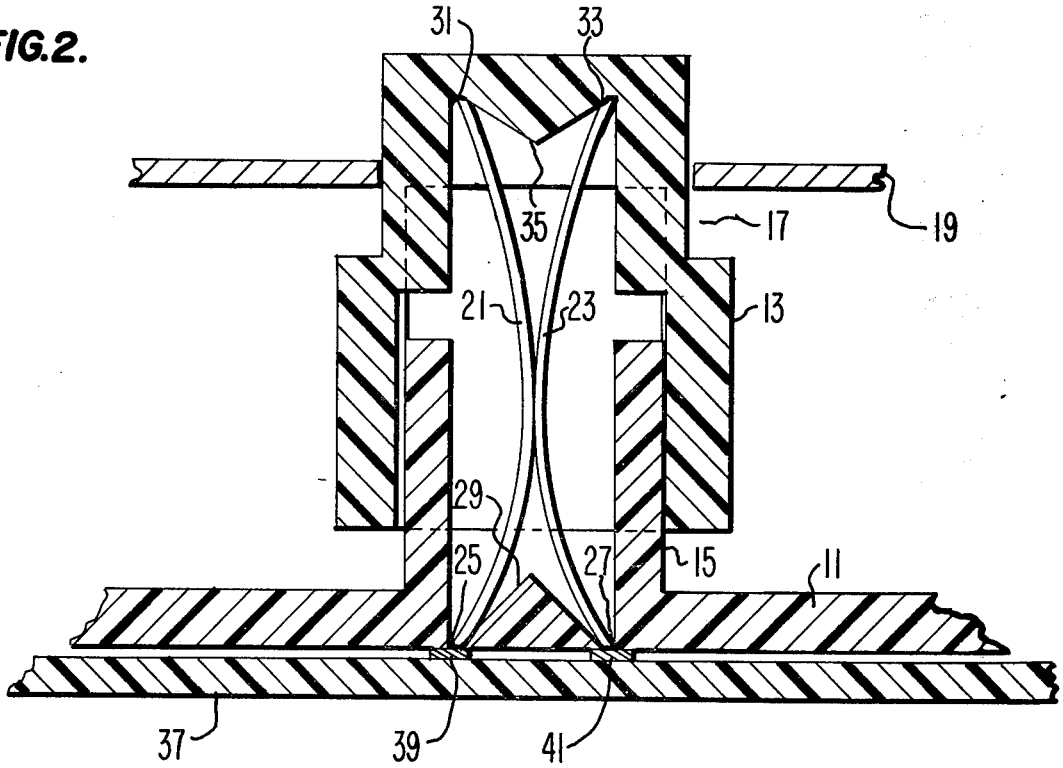
FIG. 2 is a cross section view of the present invention showing the switch in an actuated position with the leaf springs engaged.

The operation of the switch assembly is as follows. Depression of the keytop plunger 13 will force the leaf springs 21, 23 to bow towards each other. Since an initial bias has been placed on the column leaf springs 21, 23 the amount of force required to initiate bowing is approximately equal to the force required to continue the bowing of the strings. Upon sufficient depression of the keytop plunger 13, the leaf springs 21, 23 will tangentially engage as shown in FIG. 2. At this point, a distinct increase in pressure is felt by the operator thus indicating that the switch-make point has been attained. The curved surfaces formed by the leaf springs 21, 23 are very rigid structures and therefore contact bounce is minimized. Furthermore, since the contact area is quite small, the contact pressure between the leaf spring 21, 23 is quite high because the actuating force is concentrated over the small contact area. Therefore, good electrical contact between the leaf springs 21, 23 is insured because of the high contact pressure. Thus, it is apparent that the above described structure achieves effective electrical contact while minimizing the complexity of the switch assembly.

Figure 3:
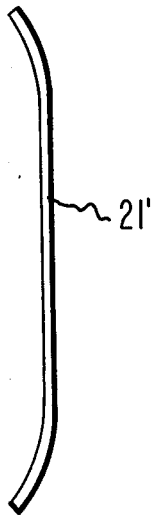
FIGS. 3 and 4 are horizontal cross sectional views of horizontally curved column leaf springs which may be used in the present invention.
Figure 4:
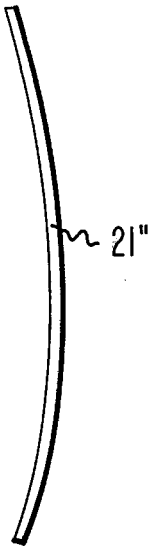

FIGS. 3 and 4 are horizontal cross section views of curved leaf springs 21' and 21'' either of which may be used in place of the leaf springs 21, 23. The following description specifies the use of the curved leaf spring 21' but is equally applicable to the use of the curved leaf spring 21''. A pair of curved leaf springs 21' may be mounted in the structure of the present invention in substantially the same manner as the leaf springs 21, 23. The curved leaf springs 21' would be mounted with their respective convex sides toward each other since the curvature of the curved leaf springs 21' allow the leaf springs 21' to bend only toward each other when mounted in this manner. Therefore, it is not necessary that the inside surface of the vertical support member 15 provide an initial bias on the curved leaf springs 21', because the horizontal cross sectional curvature of the curved leaf springs performs the function of the initial bias which must be placed on the leaf springs 21, 23.

The curved leaf springs 21' exhibit a different force-displacement characteristic from that of the column leaf springs 21, 23 and thereby provide for tactile feedback indicating depression of the keytop plunger 13. The force exerted by the curved leaf springs 21' is characterized by the requirement of the application of an initiating force which is greater than the force required to continue bowing of curved leaf springs 21' toward each other. That is, the force required to initiate depression of the keytop plunger 13 is greater than the force required to continue depression of the keytop plunger. This characteristic is caused by the fact that the cross sectional curvature of the curved leaf springs 21' creates a more rigid column cross section modulus than exists in a flat leaf spring, such as leaf springs 21, 23, of the same thickness. This more rigid column exists when the curved leaf spring 21' is in an unbowed configuration. Application of a sufficient force on the keytop plunger 13 causes the curved leaf springs to buckle toward each other. After the initial buckling of the curved leaf springs 21' the amount of force required to continue bowing is less than the force required to initially buckle the curved leaf springs 21' because the cross section modulus is significantly changed as it is bowed and the column becomes less rigid. This reduced force required to continue the bowing of the curved leaf spring 21' is about the same as the force required to bow a flat spring of the same thickness. It is therefore possible to use a thinner curved leaf spring 21' to achieve a high critical buckling load to prevent accidental depression while providing a push-button switch which requires less work to operate because of the changes in the section modulus as leaf springs buckle. A further advantage of the curved leaf springs 21' is that a curved leaf spring 21' may be shorter than column leaf springs 21, 23 because high stress, which is proportional to thickness, limits how short the respective leaf springs may be. The curved leaf spring 21' is of low stress design because it can be made thinner while providing a sufficiently high critical buckling load to avoid accidental contact. Therefore, a lower profile may be achieved by the shorter curved leaf spring 21'.

Figure 5:
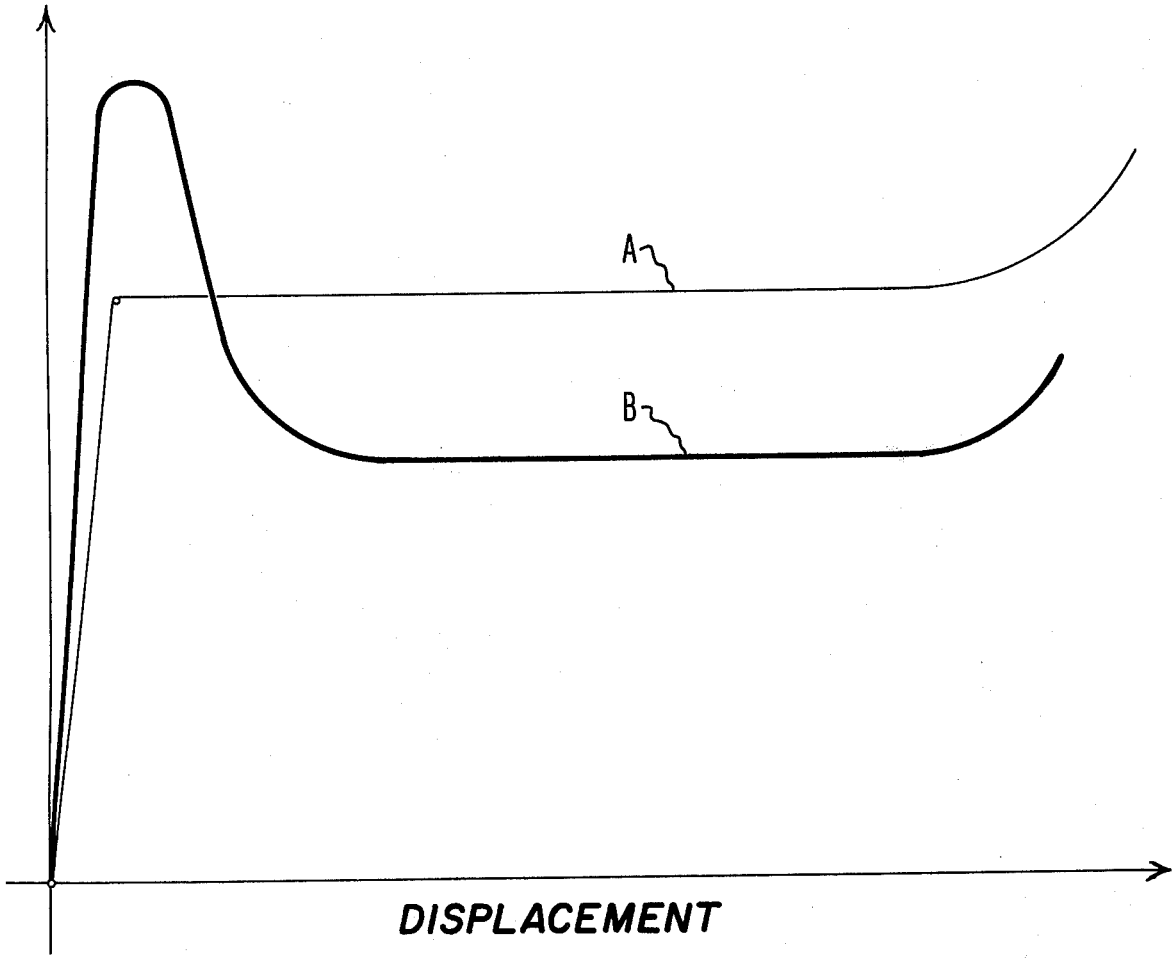
FIG. 5 is a graph of the force-displacement characteristics of the present invention when used with flat column leaf springs and curved column leaf springs.

The difference in the force-displacement characteristics for flat column leaf springs 21, 23 and horizontally curved leaf springs 21' or 21'' is illustrated in FIG. 5. Curve A is the characteristic for flat column leaf springs 21, 23; and curve B is the characteristic for curved leaf springs 21' or 21'' which are thinner than the flat leaf springs used to obtain curve A.

From the foregoing it will be obvious to those skilled in the art that various modifications may be made within the spirit and scope of the present invention as defined by the following claims.

What is claimed is:

1. An electrical switch assembly for tactile manipulation comprising:

a rigid planar member;

conducting means on said rigid planar member;

a plurality of electrical contacts comprising resilient columnar biasing means each having an upper end and a lower end and a medial portion, said columnar biasing means each being mounted on said rigid planar member with respective lower ends of said columnar biasing means engaging said conducting means, said columnar biasing means resiliently bowing toward each other into contacting engagement at their respective medial portions when actuated while maintaining constant distances between their respective upper and lower ends, said contacting medial portions completing an electrical conductive path when engaged;

means acting on the upper ends of said columnar biasing means when tactile pressure is applied thereto for downward movement to actuate said opposing columnar biasing means to bow towards each other; and limiting means in juxtaposition with said actuating means for insuring that said columnar biasing means bow only toward each other when actuated by said actuating means, said resilient columnar biasing means restoring said actuating means when pressure is removed therefrom.

2. The electrical switch assembly of claim 1 wherein each of said columnar biasing means has its bottom end fixedly mounted on said planar member and its upward end downwardly displaceable by said actuating means.

3. The electrical switch assembly of claim 2 wherein said columnar biasing means comprises a column leaf spring.

4. The electrical switch assembly of claim 3 wherein said plurality of column leaf springs comprises a pair of opposed, parallely disposed column leaf springs facing one another.

5. The electrical switch assembly of claim 4 wherein said actuating means comprises a keytop plunger for simultaneously acting upon the upper ends of said column leaf springs.

6. The electrical switch assembly of claim 5 wherein said limiting means includes a surface fixedly located with respect to said rigid planar member for each of said leaf springs, said fixed surface being located to place an initial bias on its corresponding leaf spring when said leaf is not actuated.

7. The electrical switch assembly of claim 5 wherein said limiting means comprises a curvature in each of said leaf springs having its convex side disposed toward the opposing leaf spring.

8. An electrical switch assembly for tactile manipulation comprising:

a rigid planar member;

conducting means on said rigid planar member;

a plurality of electrical contacts comprising resilient columnar biasing means each having an upper end and a lower end and a medial portion, said columnar biasing means each being mounted on said rigid planar member with respective lower ends of said columnar biasing means engaging said conducting means, said columnar biasing means resiliently bowing toward each other into contacting engagement at their respective medial portions when actuated while maintaining constant distances between their respective upper and lower ends, said contacting medial portions completing an electrical conductive path when engaged;

means acting on the upper ends of said columnar biasing means when tactile pressure is applied thereto for downward movement to actuate said opposing columnar biasing means to bow towards each other;

means for linearly guiding the displacement of said actuating means; and limiting means in juxtaposition with said actuating means for insuring that said columnar biasing means bow only toward each other when actuated by said actuating means, said resilient columnar biasing means restoring said actuating means when pressure is removed therefrom.

9. The electrical switch assembly of claim 8 wherein each of said columnar biasing means has its bottom end fixedly mounted on said planar member and its upward end downwardly displaceable by said actuating means.

10. The switch switch assembly of claim 9 wherein said columnar biasing means comprises a column leaf spring.

11. The electrical switch assembly of claim 10 wherein said plurality of column leaf springs comprises a pair of opposed, parallely disposed leaf springs facing one another.

12. The electrical assembly of claim 11 wherein said actuating means comprises a keytop plunger for simultaneously acting upon the upper ends of said column leaf springs, said plunger surrounding the upper portion of said column leaf springs.

13. The electrical switch assembly of claim 12 wherein said guiding means comprises a rigid member surrounding said leaf springs and fixedly extending from said rigid planar member, said surrounding member being slideably captured within said plunger to allow linear displacement of said keytop plunger.

14. The electrical switch assembly of claim 13 wherein said limiting means comprises surfaces within said surrounding member abutting said column leaf springs for placing an initial bias on each of said leaf springs when they are not actuated.

15. The switch assembly of claim 14 wherein said limiting means comprises a curvature in each of said leaf springs having its convex side disposed toward the opposing leaf spring.

* * * * *